US005511592A

United States Patent [19]

Kiel

[11] Patent Number: 5,511,592

[45] Date of Patent: Apr. 30, 1996

[54] SPARE BOTTLE FOR AN INK REFILLING OF PISTON-TYPE FOUNTAIN PENS OR OF WRITING IMPLEMENTS FITTED WITH AN INK RESERVOIR AND AN INK CONDUCTING SYSTEM

[76] Inventor: Volker Kiel, Am Wasserbett 7, 68526 Ladenburg, Germany

[21] Appl. No.: 139,376

[22] Filed: Oct. 20, 1993

[30] Foreign Application Priority Data

Oct. 21, 1992 [DE] Germany ..... 92 14 185.4 U

[51] Int. Cl.[6] ..... B65B 1/04; B65B 3/04

[52] U.S. Cl. ..... 141/23; 141/21; 141/312; 141/386

[58] Field of Search ..... 141/23, 24, 312, 141/319, 320, 321, 322, 346, 349, 383, 386, 20.5, 21, 22, 25–28, 18

[56] References Cited

U.S. PATENT DOCUMENTS

| | | | |
|---|---|---|---|
| 929,360 | 7/1909 | Wright | 141/320 |
| 1,494,772 | 5/1924 | Dall | 141/320 |
| 1,910,495 | 5/1933 | Parker | 141/24 |
| 2,165,604 | 7/1939 | Abel | 141/20.5 |
| 2,234,256 | 3/1941 | Iverson | 141/320 |
| 2,494,518 | 1/1950 | Oakes | 141/320 |
| 4,524,809 | 6/1985 | Dent | 141/18 |

FOREIGN PATENT DOCUMENTS 424051 8/1947 Italy .

*Primary Examiner*—Henry J. Recla
*Assistant Examiner*—Steven O. Douglas
*Attorney, Agent, or Firm*—Anderson Kill Olick & Oshinsky

[57] ABSTRACT

In a spare bottle for an ink refilling of piston-type fountain pens or of writing implements fitted with an ink reservoir and an ink conducting system, in which refilling container (10) is provided with an attachment (13) having a substantially cylindrical docking section for the fluid-tight accommodation of a connecting piece to a refillable writing fluid chamber, more particularly for the accommodation of a terminal section of a piston-type fountain pen (14) facing the nib or a refillable ink cartridge (15) and can be closed by means of a cap portion (12) with the aid of a screwed, plugged or clipped connection, the docking section (13) further possessing a sealing collar for engaging into the neck of the refilling container (10), which is comprised of soft, elastic plastic.

10 Claims, 8 Drawing Sheets

SPARE BOTTLE FOR AN INK REFILLING OF PISTON-TYPE FOUNTAIN PENS OR OF WRITING IMPLEMENTS FITTED WITH AN INK RESERVOIR AND AN INK CONDUCTING SYSTEM

The present invention relates to a spare bottle for an ink refilling of piston-type fountain pens or of writing implements equipped with an ink reservoir and an ink conducting system.

BACKGROUND OF THE INVENTION

Fountain pen ink containers are normally configured in such a way that an essentially bellied or bulbous base section passes at the top into a narrower collar section provided with an external thread. A sealing cap can be screwed onto the collar section which, on the inside, accommodates a sealing disk which, when the screw cap is put on, is pressed in a fluid-tight fashion against the front surface of the collar section.

Apart from reposing glass containers provided with an ink withdrawal opening at the side, standing containers of plastic materials are also known. However, on account of their dimensions, such containers are not carried with them by students since they cannot be accommodated in students' cases and problems might arise when the same are carried in the school satchels, more particularly when glass containers are involved. To this is added the circumstance that a student does not require for his or her daily needs such large quantities of writing fluid (ink) as are made available by these containers.

Even though lately more and more writing implements or fountain pens equipped with ink cartridges have gained acceptance, it has nevertheless to be recorded that particularly fountain pens of high quality are for the most part constructed in the form of so-called piston-type fountain pens, i.e. they possess, in their interior, an as a rule cylindrical fluid chamber which is refillable with the aid of a piston that is actuated from the outside. This chamber may either be integrated into the fountain pen casing or be constituted by a piston cartridge, a so-called converter, which is inserted into the fountain pen in the form of a unit which has to be handled separately. In both cases, the refilling of the ink chamber is effected in that the piston is moved up to the frontmost stop so that the internal volume of the ink reservoir container restricted by the piston assumes a minimum value. A connection with the environment is established via the nib or via the front aperture of the refillable cartridge. For refilling, the nib or the front end of the piston cartridge is immersed into the ink bottle or submerged in the same so that, by the return movement of the piston, writing fluid or ink is drawn in and the ink reservoir container is filled.

Apart from the fact that this refilling operation in piston-type fountain pens is somewhat more time-consuming anyhow due to the separate handling of the ink bottle than is the case in cartridge-type fountain pens, there arises the further problem that, when refilling the ink, one generally soils at least one's hands. For, when piston-type fountain pens are refilled, the latter always have to be dipped into the ink as far as over the lower rim of the gripping portion so that the external surface of the fountain pen is often wetted by the ink far into the gripping depressions and contaminated by this. Blue or black ink can be perceived only with difficulty on the external fountain pen surfaces which frequently are finished in dark tones so that the fountain pen has to be thoroughly washed and dried before it is used again.

A further problem arises owing to the circumstance that, in piston-type fountain pens, care has to be taken when refilling that the entire nib is surrounded with ink. This results in that inkpots or ink bottles can be emptied only with difficulty. Because, once the ink level has sunk to such an extent that, when the nib is immersed, the latter does no longer lie in its entirety with a submersion dimension of approximately 1 mm below the level of the writing fluid, the fountain pen draws in "air" when being filled. With this it is impossible for the ink storage chamber in the fountain pen to be filled completely with ink so that the refilling operation has to be carried out at increasingly shorter intervals. Over and above that, the air trapped in the ink reservoir, when the fountain pen is subjected to thermal action, such as e.g. when the fountain pen is held in the hand over extended periods or when the same is exposed to solar radiation, has a negative effect in that the increasing air volume urges excessive ink from the nib.

Also in fountain pens provided with refillable cartridges it is not possible to eliminate the problems described in the foregoing, especially since, in this case, the probability of soiling one's hands is greater due to the circumstance that the cartridge, when being immersed, can only be stabilized by supporting one's fingers on the upper rim of the ink bottle neck.

It is true that it has been attempted to lessen the problem stated in the foregoing by imparting a special design to the inkpots or ink bottles so that, besides the actual main chamber, separeted by a partition, a secondary chamber is created. Thereby the ink bottle does receive a highly complex shape which renders the manufacturability more difficult and augments the costs of the ink bottle.

The invention is based upon the technical problem of providing, more particularly for students, a small and handy spare bottle for writing fluid which can be carried without any problem inter alia also in students' cases, comprising contents sufficing for approximately two to three or even more piston-type fountain pen fillings and provided with an attachment, with the aid of which one succeeds in emptying the spare bottle completely with the exception of an insignificant residual quantity and, at the same time, to facilitate the handling of the spare bottle on the one hand and of the fountain pen or the refillable cartridge on the other in such a way that the risk of soiling oneself with ink during the refilling operation is effectively checked. It is intended furthermore to increase the tightness of the spare bottle in the state in which it is closed by a cap portion or a screw cap as well as in the docked state to a writing implement and to provide a configuration with which also the filling of writing implements not provided with a suction piston having an ink reservoir and an ink conducting system as well as of ink cartridges disposed in the writing implement is possible.

SUMMARY OF THE INVENTION

This technical problem is resolved by means of a spare bottle possessing the features of the claim 1.

According to this the invention consists in that the refilling container is fabricated from a soft, elastic plastic material, by preference a LDPE (low density polyethylene). On the one hand, this plastic is resistant to fracture and, on the other, it offers the possibility, subsequent to the docking of writing implements not provided with a suction mechanism, of pressing the ink into the ink reservoir of a disposable writing implement by the compression of the ink via the ink conducting system, whereby the filling of pertinently equipped disposable writing implements is now also possible. In addition, on account of the flexible construction of the refilling container, it is possible to produce a suction effect by connecting a volume-reduced, compressed refilling container with the docking system to an ink conducting system and, by letting go of the refilling container, the same reassumes its original shape and hereby exercises a suction effect by means of the increase in the internal volume which can be used especially for the cleansing evacuation of the ink conducting system. The special advantage exists in that empty ink cartridges disposed in the fountain pen can remain in the same and can be refilled with ink once more.

Further developments of the invention are described in the subclaims.

Thus the attachment will preferably be lockingly engaged or welded with/to the refilling bottle depending on whether the attachment is intended to be detachably connected to the refilling bottle or whether the same can be fabricated in the form of a one-piece part e.g. by injection molding. Such a connection also ensures a substantially better sealing between the attachment and the refilling container in lieu of screwed connection between these two components.

A further improvement in the sealing is provided by the use of annular beads or annular seals as locking means with a corresponding constriction or recess on the respective counterpart, i.e. between the attachment and/or the refilling container neck.

In order to improve the tightness of the cap portion relative to the attachment, the cap portion is provided with a center pin which, in the closed state of the spare bottle, rests selingly against the attachment casing interior with its casing side. If the attachment mount only has a collar which leaves a central opening unblocked which rests sealingly opposite the bottom surface of the center pin, a large-surface sealing at several points can be provided. With a view to improving the tightness, the cap portion will, with its inner casing at least at one point, preferably though at two points, bear sealingly upon the outer casing of the attachment. These points may, on the one hand, be constructed on the upper neck of the docking section and, on the other, within the region of the connection of the casing to the refilling container in the form of an outwardly inverted annular bead. A further improvement of the sealing is provided by the docking section which possesses a conically configured cylinder casing which, subsequent to the cover portion having been slipped over, rests sealingly on both sides upon the cap portion, possibly while subjected to surface pressure.

According to another embodiment, the cover portion may, preferably within the region of the pin, comprise an absorbent wick which projects outwardly from the cap portion. This wick is intended to enable one to wipe off possibly remaining residual ink or other contaminations.

If the wick is located in the hollow space of the center pin which is accessible from the outside, in that case the cap portion can be detachably connected to an upper sealing cap which shields the wick. It is ensured hereby that the user of the writing implement, after having put on the sealing cap, no longer comes in contact with the fluid-saturated wick. By preference, the cap portion and the sealing cap are capable of being screwed together. In order to ensure that the fluid absorbed by the wick is able to evaporate, the sealing cap is provided with a bore which is open to the outside, which ensures a drying of the wick within a short period of time until the next time it is going to be used.

According to a further embodiment of the invention, the attachment and/or the docking section—for the accommodation of a writing point of a disposable implement—is constructed with an ink reservoir and an ink flow conducting system having a temperature and pressure compensating system, the connecting point between the writing point and the docking section adapted with regard to the geometry is preferably secure against fluid leakage, thus fluid-tight. In such a case it is possible to urge writing fluid into the ink reservoir by compressing the filling bottle. By relaxing the pressure on the bottle it is possible to once more compensate the previously produced excess pressure in the writing implement by a withdrawal into the bottle, on which occasion, by means of the air being drawn back into the filling bottle, it is possible to effect an automatic evacuation of the ink conducting and compansating system.

In addition, the invention comprises a construction of the spare bottle in the way that the same possesses small dimensions and is provided to contain approximately two or three piston-type fountain pen fillings. Owing to its dimensions, the spare bottle is handy, can be readily carried by students in students' cases and, if the spare bottle is fabricated from plastic, then it is infrangible. It can consequently be carried without any problems since the spare bottle, on account of its dimensions, does not take up more space than three ink cartridges. The design of the spare bottle can be any whatever; it is constructed in the form of an injection-moldede article or in the form of a hollow blown body and, in the lip, terminates in a docking lock. The spare bottle is sealed with a two-piece cap. The inner portion of the cap to be screwed onto the spare bottle constitutes a pipette point which is open at its tip. With this pipette point and a single compression and cancellation of the pressure on the spare bottle, it is possible for the same to be refilled from a larger ink bottle at any time. The protective cap to be screwed over this pipette point seals the aperture against the leakage of ink following this refilling operation.

Furthermore, an attachment is provided for the spare bottle against which the piston-type fountain pen or the piston-type cartridge can be docked in a fluid-tight manner, in which case a click-locking or snap-action locking means is preferably provided so as to ensure an accurate position-wise positioning of the fountain pen to be refilled or of the cartridge to be refilled with regard to the attachment or the spare bottle. When the piston is subsequently displaced in the forward direction and air is accordingly displaced from the ink reservoir into the spare bottle, a slight excess pressure is produced inside the spare bottle. Due to the fluid-tight sealing between the fountain pen and the spare bottle, it is only possible to bring the latter into an upside-down position so that the ink or residual ink present in the spare bottle flows into a region which directly surrounds the nib of the fountain pen or the orifice of the refillable cartridge in such a way that even a small residual quantity of ink in the spare bottle suffices to surround or to flow around the entire nib of the fountain pen. By turning the piston back, the ink, assisted by the slight excess pressure in the spare bottle, is drawn into the fountain pen or into the refillable cartridge devoid of air or bubbles, whereupon the spare bottle can once again be turned around into the normal position. However, there also exists the possibility of inserting the attachment onto the end of the piston-type fountain pen, to leave the attachment inserted and to immerse the same together with the fountain pen nib into the spare bottle so as to carry out a filling operation.

During the entire filling operation, owing to the fluid-tight and, therefore, form-fitting, edge of the fountain pen or of the ink cartridge, solely the front end region adjacent to the nib or the cartridge inlet aperture is wetted by ink. Within this region it is possible to eliminate the ink or to wipe off the same with a substantially reduced effort. Subsequent to the refilling, the fountain pen or the refillable cartridge can accordingly be handled in a problem-free manner without running the risk of soiling one's hands or fingers with ink when touching the fountain pen or the ink cartridge once more. The attachment is also suited to be a retrofit part for such writing fluid containers.

Advantageous further developments of the invention are the subject matter of the subclaims.

A minimization of the residual ink volume surrounding the fountain pen nib in the upside-down position of the spare bottle results with the further development of claim 8. This minimal volume can best be made available when, according to claim 12, the docking section, in extension of the collar section, joins the same via a radial constriction shoulder.

The attachment, according to an advantageous further development, can be fitted with adapters in order to take the different geometries of the fountain pen points or of the refillable cartridges into consideration. The docking section may, either itself at least within the region of the sealing surfaces toward the fountain pen be configured so as to be radially elastic or in such a way as to be capable of being equipped with elastic inserts.

Further advantageous embodiments of the invention are the subject matter of the subclaims.

BRIEF DESCRIPTION OF THE DRAWINGS

Embodiment examples of the invention are explained in greater detail below with the aid of the drawings. Thus

DETAILED DESCRIPTION OF THE PREFERRED EMBODIMENT

Figure 1:
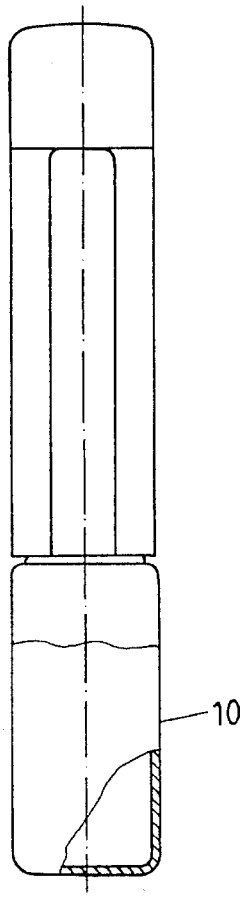
FIG. 1 shows a side view of a spare bottle.
Figure 2:
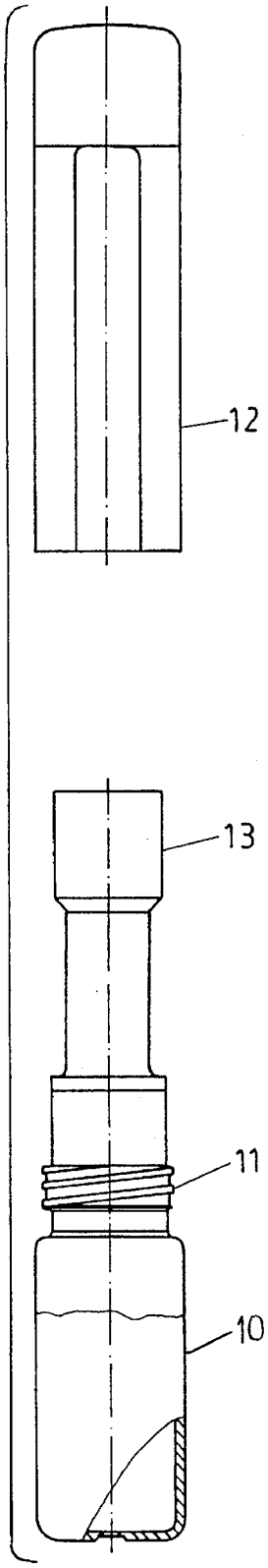
FIG. 2 shows the same side view of the spare bottle according to FIG. 1 with the cap portion removed.
Figure 3:
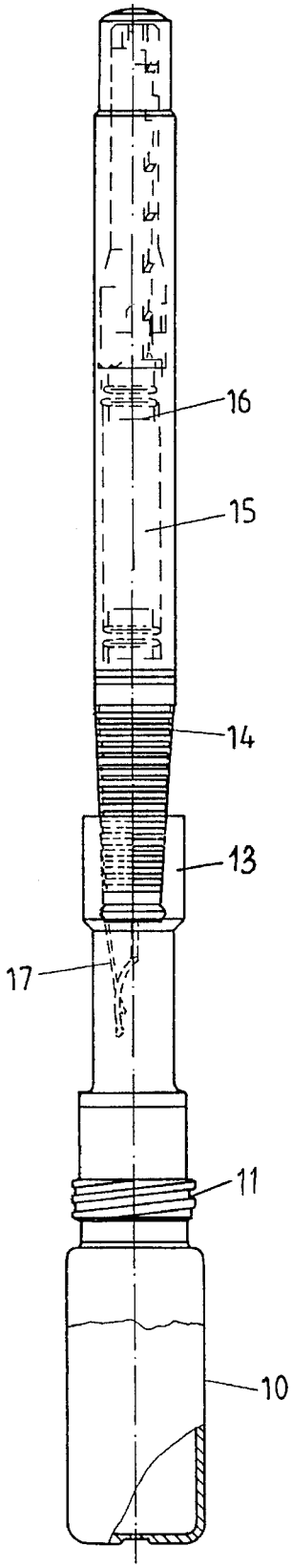
FIG. 3 shows a side view of the spare bottle according to FIG. 1 with docked piston-type fountain pen.
Figure 4:
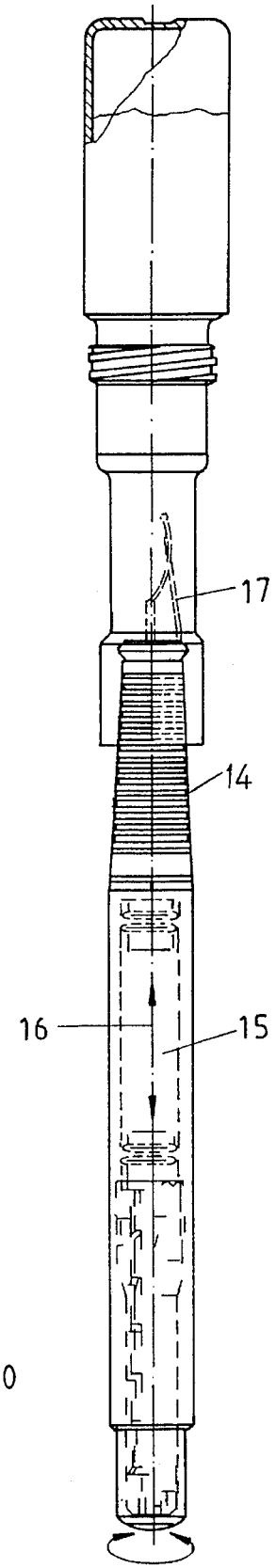
FIG. 4 shows the same view as in FIG. 3 with components turned upside down through 180°.

The spare bottle depicted in the FIGS. 1 through 5 comprises a refilling container 10 of a soft, elastic plastic material, by preference LDPE. The refilling bottle 10 possesses dimensions which preferably ensure a content corresponding to two to three piston-type fountain pen fillings or of other writing implement fillings so that the spare bottles can be readily accommodated in students' cases. On its neck piece, the spare bottle is provided with an external thread 11, onto which a correspondingly constructed internal thread of a cap portion 12 can be screwed. The cap portion 12, as can be gathered from FIGS. 2 and 3, is capable of engaging over both the docking section and/or the attachment in the form of an adapter piece and, possibly, parts of a neck portion of the refilling bottle 10 in the closed position. The cap portion 12, too, is comprised of plastic which, however, does not necessarily have to be soft and elastic. In the spare bottle according to the FIGS. 1 through 5, the bulbous part of the refilling bottle passes, via a shoulder, into a neck which terminates in a docking section 13, whose inner casing contour is constructed in such a way that a piston-type fountain pen inserted as per FIG. 3 rests therein in a sealed fashion and can be rotated through 180° without any risk of the ink leaking out, as is illustrated in FIG. 4. The docking section 13 can be constructed both so as to correspond to the terminal section of a piston-type fountain pen provided with the nib as well as so as to correspond to the terminal section of a refillable ink cartridge or also so as to correspond to a different writing implement according to FIG. 5. The docking section 13 may be provided with an upper collar which corresponds to a fluid-tight seal of the cap portion 12 with an annular web of said cap portion in such a way that the annular web is made to rest upon the upper collar of the docking section so as to be fluid-tight in the closed state. The docking section may be constructed in such a way as to be adaptable to all the piston-type fountain pen diameters, e.g. by the selection of a springably elastic material. If the docking section 13 is not constructed in one piece with the spare bottle 10, the same may, with the aid of an external or internal thread, be detachably connected to a pertinently corresponding threaded part of the refilling container or of the neck of the latter. In this case, too, additional sealing lips and collar pieces which bear against each other in the closed state, may ensure an increased fluid tightness. It is also possible for the docking section 13 to be provided with an annular bead of rubbery elastic material on its inner casing, against which the piston-type fountain pen 14 is pressed in the closed state. This can be done in that the annular bead tightly encloses the end of the piston-type fountain pen in a radial fashion. The filling of the ink reservoir or of an ink cartridge 15 of the piston-type fountain pen may be effected in the position shown in FIG. 3 or in the upside-down position as per FIG. 4, in which case the piston 16, prior to the filling operation, is displaced as far as possible in the direction of the nib, in order to then withdraw the piston in the opposite direction and to hereby draw off ink. A filling in the upside-down position according to the FIG. 4 offers the advantage that, doing this, the nib is still placed so as to be under fluid even if the spare container 10 is partly emptied. However, the filling in the upside-down position requires a fluid-tight connection of the fountain pen to the docking section.

Figure 5:
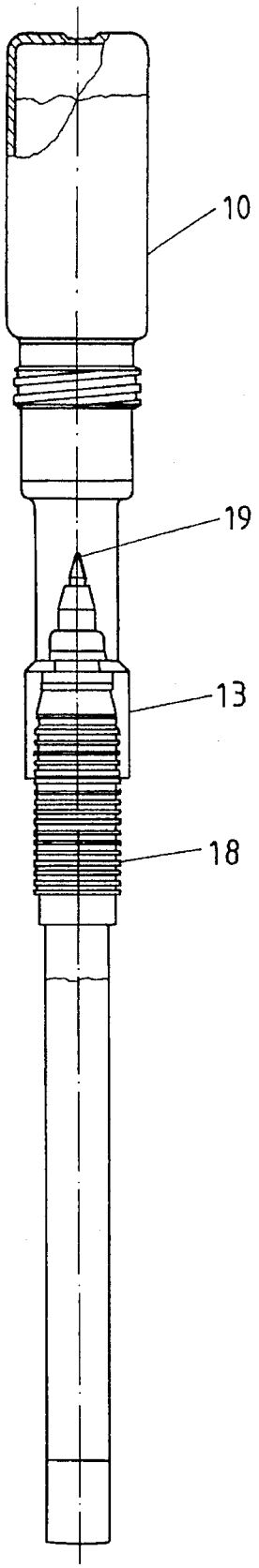
FIG. 5 shows the side view of a spare bottle with docked writing implement with ink reservoir and ink flow conducting system and temperature and pressure compensating system.

While the filling of piston-type fountain pens is problem-free due to the filling mechanism available there, all writing implements which are not equipped with any filling mechanism had to be discarded up to now. This constitutes a grave ecological damage, which is all the more serious since most of the implements are still operable if only it were possible to have them refilled. Hereby the service life of a writing point could be fully utilized. In the case of the docking section 13 according to the invention, which is capable of providing a fluid-tight connection with the writing implement 18, it is possible with an elastic refilling container 10, by compressing the same, to urge writing fluid into the reservoir of the writing implement 18. If one relieves the pressure again on the bottle subsequent to the ink having been urged via the ink conducting system into the reservoir, then the previously generated excessive pressure in the writing implement is compensated once more in the direction of the bottle, by means of which, owing to the air being drawn back into the refilling bottle, the automatic evacuation of the ink conducting and compensating system is brought about. What is essential in this connection is the safetying against leakage which, on the one hand, prevents the escape of writing fluid when the bottle is inadvertently upset and, on the other, that, subsequent to the pressure being removed from the filling fluid during the filling operation, writing fluid is able to flow in once again. It is ensured hereby that the compensating system of the ink conductor is not automatically refilled until the writing implement 18 is undocked. The ink reservoir of the writing implement 18 can, if necessary, be filled by means of repeated pressing, after which the writing point 19 is again ready for use as long as its quality permits this. As writing implements 18, inkers, fine lining pens, fiber pens, markers and comparable implements are taken into consideration. The refilling merely requires that the implements be provided with an ink reservoir for writing fluid and with an ink conducting system having a temperature and pressure compensating system. It is not possible to refill tampon or plug type reservoirs. The filling operation according to FIG. 5 is effected as detailed in the following.

The writing implement 18 is first of all docked on the writing side to the docking section 13 of the refilling bottle 10. After that the implement is brought into a position in which the writing point 19 points upwardly and the spare bottle 10 is seated vertically there upon. By repeatedly pressing on the spare bottle 10, the writing fluid present in the latter is pumped into the reservoir of the writing implement 18. Since these writing implements 18 possess, as a rule, transparent reservoirs, it can be readily ascertained when the writing implement is filled. Sub sequent to the refilling, the writing implement is, together with the refilling bottle, around again so that the writing point points downturned ward once more and it is possible to unlock the writing implememnt from the refilling bottle. If necessary, writing fluid will still have to be cleaned off the writing point 19 before the writing implement is put back into use. The spare bottle 10 is closed again by the cap portion 12 being screwed on.

Figure 6:
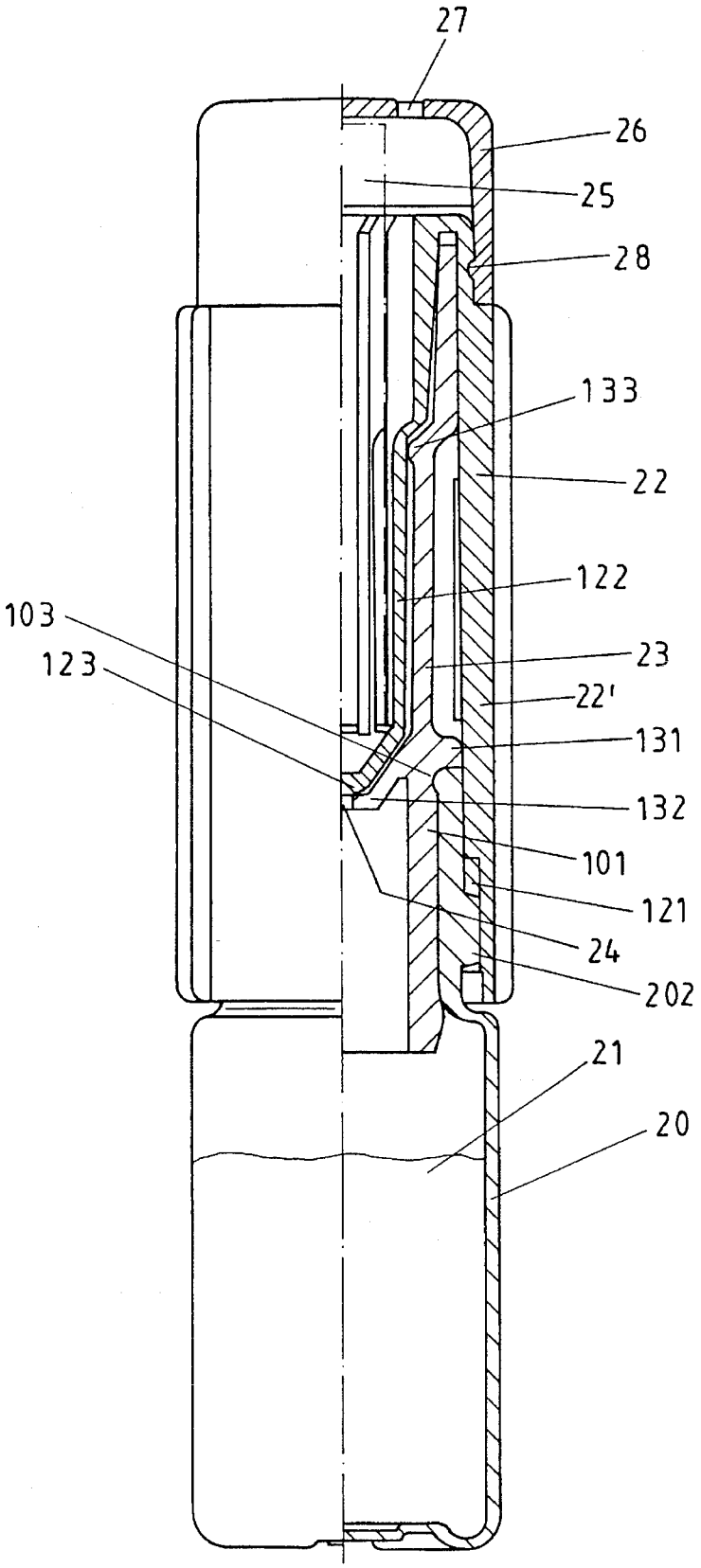
FIG. 6 shows a partially sectioned side view of a further embodiment of the spare bottle according to the invention.

In FIG. 6, a further embodiment of the spare bottle according to the invention is illustrated. There, the spare bottle 10 of plastic material contains writing fluid in a known manner. From a bulbous section, the spare bottle 20 passes, via a shoulder, into a neck 101 having a smaller diameter. On its outer casing, this neck is provided with a thread 102, which can be closed with the corresponding thread 121 of a cap portion that can be screwed thereupon. On its upper end, the neck is provided with an inwardly projecting annular bead 103 which rests sealingly upon an attachment 23 acting as an adapter. This attachment 23 is substantially configured in a tubular fashion and it projects with its lower end into the neck 101, while the outer casing of this attachment 23 bears tightly against the neck 101. In this case the annular bead 103 may possibly be located in a pertinently designed groove of the attachment 23. The attachment 23 possesses a further ring 121 which is turned toward the outside which is supported above the front side of the neck 101 and thus gives rise to an additional sealing. The attachment 23 may be connected to the refilling container 20 with the aid of a compression or a locking connection; however, it may also be constructed so as to be integral with the same. In addition, the attachment 23 possesses a substantially continuous, inwardly directed collar 132 which is provided with only one central opening 24 which, however, is sealed in the closed position. Toward its free end, the attachment 23 may be provided with a conically tapering container wall. Over and above that it may be provided with further cams, annular bodies, beadings or drawn-out S-like shapes, as indicated at reference number 133, which preferably provide a further sealing point.

In contrast to the normal, mostly cup-shaped sealing portion, the cap portion 22 according to FIG. 6 is provided with a center pin 122 which, in the closed position of the spare bottle, rests sealingly with its casing side upon the attachment casing inside. More particularly, this center pin 122 has a closed bottom 123, which both bears tightly against the collar 132 as well as closing the bottom opening 24. The center pin 122 and the cap portion 22 thus enclose the attachment 23 within its internal and external region above the neck 101. By means of the center pin 122, a rest space accessible from the outside is provided in which an absorbent wick 25 is located which projects on its free side from the center pin 122. This wick is comprised of absorbent material for the cleaning of the writing implements or suchlike.

The outer casing 22' of the cap portion 22 as well as the wick 25 are closed on the end which faces away from the spare bottle 20 by means of a sealing cap 26 which is provided with a drilled hole 27, through which air is able to enter into the interior. The sealing cap 26 is either screwed together with the attachment 22 or is connected via a cam-ring-bead-groove connection 28.

The spare bottle according to FIG. 6, with the attachment 23, possesses an adapter which is locked or welded with/to the refilling container 20, whereby a fluid-tight connection is provided. Furthermore, the attachment 23 is provided with a leakage safety means (at the points identified with 132 and 133), which prevents with certainty the leakage of writing fluid if the bottle were to be inadvertently upset. The leakage-preventing safety means is constructed in such a way that the attachment 23, in the direction of the spare bottle 20, constitutes a closure in the form of a bottom which can be opened by means of the small drilled hole 121.

The size of the drilled hole 24 is selected in such a way that, on the one hand, no writing fluid is able to escape, but that, on the other, both the filling operation of the writing implement a s well as the refilling of the bottle is possible. The advantages of the attachment reside in the leakage-preventing safety means and in the possibility of being able to replace the attachment on the spare bottle 20 by disengaging the click-stop connection and the snapping-in of a new connection so a s to provide various docking possibilities for different writing implements. The cap portion which receives the attachment 23 and the neck 101 inside itself and seals them at the same time is constructed in such a way that, on the one hand, the same seals the opening of the leakage-preventing safety device in the attachment 23 as well as rendering the attachment 23 generally fluid-tight so that an infrangible and leakproof unit with the spare bottle 20 is produced. The sealing of the leakage-preventing safety device is effected in particular by the center pin 121 as a part of the cap portion 22. When the cap portion is screwed tight, the center pin 122 closes the aperture of the bore 24 so that a leakage-preventing safety device is formed. At the same time, the upper rim of the attachment 23 is clamped and thus likewise sealed by the conically tapering bore of the cap portion and the conically configured pin sealing the leakage-preventing safety means.

The refilling of the spare bottle from an ink bottle is effected as detailed in the following.

Subsequent to the cap portion having been unscrewed, the attachment is dipped into the ink bottle and the refilling bottle is compressed. After that the refilling container—the refilling bottle—is released and the tension relief of the bottle awaited. The bottle can be removed with the adapter from the ink bottle and the writing fluid be removed from the soiled adapter. Finally,the sealing cap is screwed on.

The refilling of a piston-type writing implement or of some other writing implement with a refilling ink container is carried out as detailed below.

After the unscrewing of the sealing cap, the writing implement is pressed into the attachment until a click-stop engagement occurs in the region of the annular seal 133. The writing implement with the docked refilling bottle is now held vertically upward before the piston of the writing implement is screwed forwardly, whereby the air present in the writing implement is pressed into the spare bottle 20 and an excess pressure is generated. After that the piston is screwed back, whereby the ink from the spare bottle 20, via the leakage-preventing safety means, is drawn into the implement via the ink conducting system. In this state, both the writing implement reservoir as well as the ink conducting and pressure compensating system of the writing implement are filled. However, the latter will still have to be evacuated in order to ensure that no writing fluid will be able to leak out when changes in temperature or air pressure do occur. This evacuation can be effected in two ways.

Either, after the piston is screwed back in the writing implement on which the filling operation has been performed, in the same position as in the filling operation, the spare bottle 20 is squeezed twice, whereby insignificant quantities of writing fluid are still pressed into the implement. However, when the spare bottle 20 undergoes the tension relief, the air from the writing implement is drawn through the ink conducting and compensating system, whereby the writing fluid present in the system is removed with the air flowing through and is drawn back into the spare bottle 20. Hereby the compensating system is evacuated, the writing implement is ready for use and can be subjected to stress. By way of alternative to this, after the piston is screwed back in the writing implement on which at the same time the filling operation has been carried out, the writing implement with the docked filling bottle and the adapter can be turned around so that the nib comes to point vertically downward. If the rotating bottom which moves the piston is turned to the right by one rotatation, then two to three drops of writing fluid drop off. After that the piston is once again turned back by a rotation to the left, whereby air from the refilling bottle is drawn through the compensating system and the remaining writing fluid is removed. The compensating system is also evacuated hereby so that the writing implement is ready for use and can be subjected to stress. Any possible remainders of ink or writing fluid can be removed with the aid of the wick 25, for which purpose the sealing cap 26 is first removed. By means of the opening 27 it is ensured that the wick will gradually dry out again.

Figure 7:
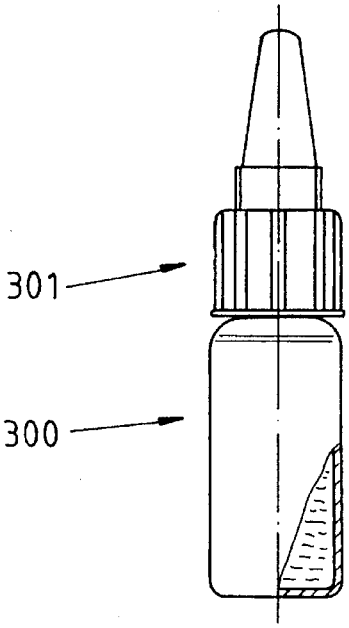
FIG. 7 shows a spare bottle in a side view.
Figure 8:
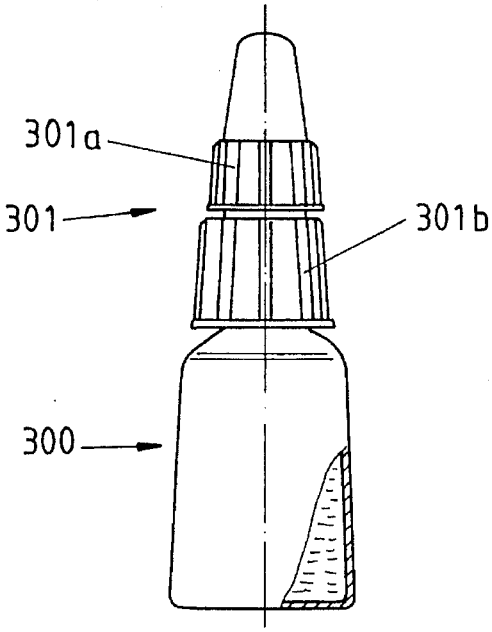
FIG. 8 shows, in a side view, a further embodiment of a spare bottle with a two-piece screw cap.

The spare bottle depicted in FIGS. 7 and 8 and identified with 300 is preferably comprised of plastic materials, it being also possible for springably elastic plastics to be employed in the fabrication of the spare bottle. This spare bottle 300 possesses small dimensions so as to enable e.g. students to carry the same in students' cases without the spare bottle taking up much space for its accommodation. By preference the dimensions of the spare bottle 300 are such that the same holds the contents of approximately two or three piston-type fountain pen fillings, which corresponds to roughly 3 $cm^3$. However, the possibility also exists of imparting larger dimensions to the spare bottle 300 so that it comprises contents which correspond to more than three piston-type fountain pen fillings.

The spare bottle 300 is provided with a screw cap 301 which, in the embodiment shown in FIG. 7, is of a one-piece construction and, in the embodiment shown in FIG. 8, it is of a two-piece construction. The two cap sections are identified with 301*a*, 301*b*.

Figure 10:
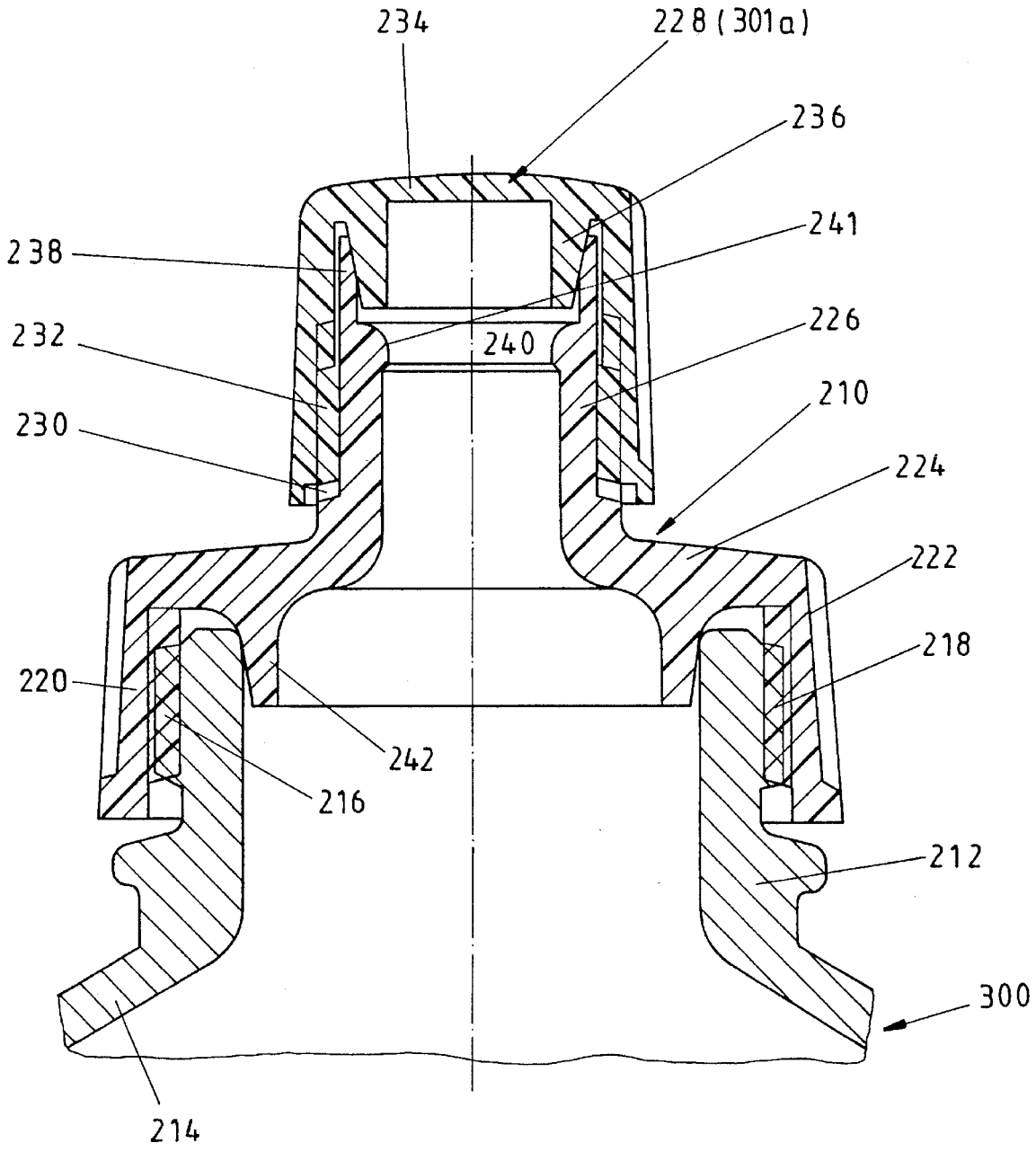
FIG. 10 shows a vertical section of the upper region of the spare bottle with screwed-on attachment according to a first embodiment.
Figure 11:
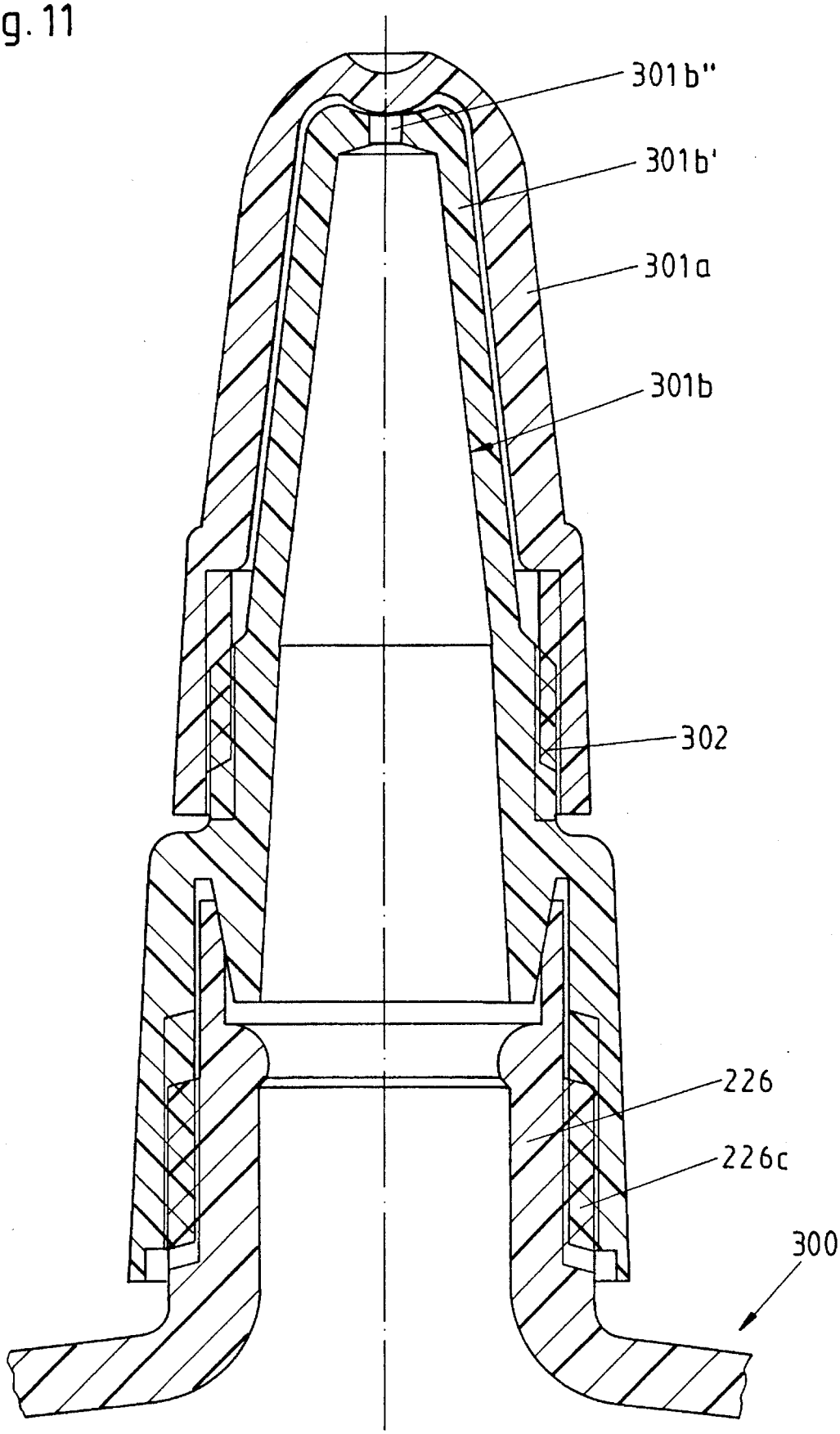
FIG. 11 shows a vertical section of the upper region of the spare bottle with two-piece screw cap and a nozzle-like terminal configuration.

In FIG. 10, an attachment in the form of a plastic screw cap is identified with 210 which is screwed onto a neck 212 of the spare bottle. The neck 212 constitutes the tapered end of the otherwise bulbously constructed ink container. An external thread of the spare bottle is identified with 216, this thread is operatively engaged with an internal thread 218 of a collar section 220 (FIG. 11). Groove-like recesses in the external circumferential surface of the collar section are indicated with 222, these form gripping zones for the facilitation of the screwing-on and unscrewing of the attachment 210.

Via a radial constriction shoulder 224, the cylindrical collar section 220 passes into a likewise cylindrical docking section for the, on all sides, sealed, form-fitting reception of a connecting piece not shown in greater detail in FIG. 10 to a refillable writing fluid or ink chamber. This connecting piece is, by way of example, formed by a terminal section of a piston-type fountain pen facing the nib or by the terminal section of a refillable ink cartridge which, according to FIG. 10, can be introduced from above into the docking section 226 after the removal of a screw cap 228 which constitutes the sealing cap 301 of the spare bottle 300.

For this purpose, the docking section 226 is provided on the outside with an external thread 230 and the screw cap or the screw cover 228 with an internal thread 232, in which case, for the fluid-tight sealing of the attachment 210, an annular web 236 projects from the terminal wall 234 which is made to bear in a fluid-tight manner against the upper collar 238 of the docking section 226 when the screw cap 228 is screwed down. The docking section 226 is adaptable to all fountain pen diameters; for this purpose the docking section may be comprised of springably elastic material, such as plastic.

With 240, a sealing lip region is identified which, when the connecting piece is connected for the refillable writing fluid chamber, i.e. for the fountain pen point, comes to bear snugly against the external circumference of the connecting piece, in which case preferably a lockably engaging or at least a spring-loaded snap-in connection between the docking section 226 and the fountain pen or the cartridge to be refilled is brought about. For this serves a sealing lip annular bead 241. The sealing lip region 240 or the annular bead 241 is for this reason adapted to the geometry of the terminal region of the fountain pen point facing the nib in such a way that the sealing lips, at a predetermined point of the fountain pen or of the refillable cartridge, enter into a spring-loaded engagement with a corresponding outer surface area of the fountain pen or the cartridge so that the fountain pen or the cartridge, after the docking, on the one hand, is radially positioned with regard to the attachment 210 and, on the other, also in the axial direction, is accurately fixed positionwise. In this connection it is advantageous when the docking section 226 is constructed so as to be at least in part radially elastic, which can be controlled by a suitable selection of the material for the attachment 210.

Figure 9:
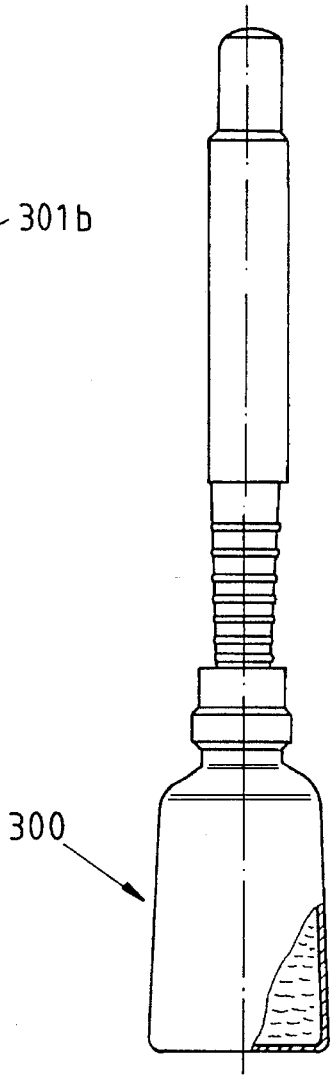
FIG. 9 shows, in a side view, a spare bottle with inserted fountain pen.
Figure 12:
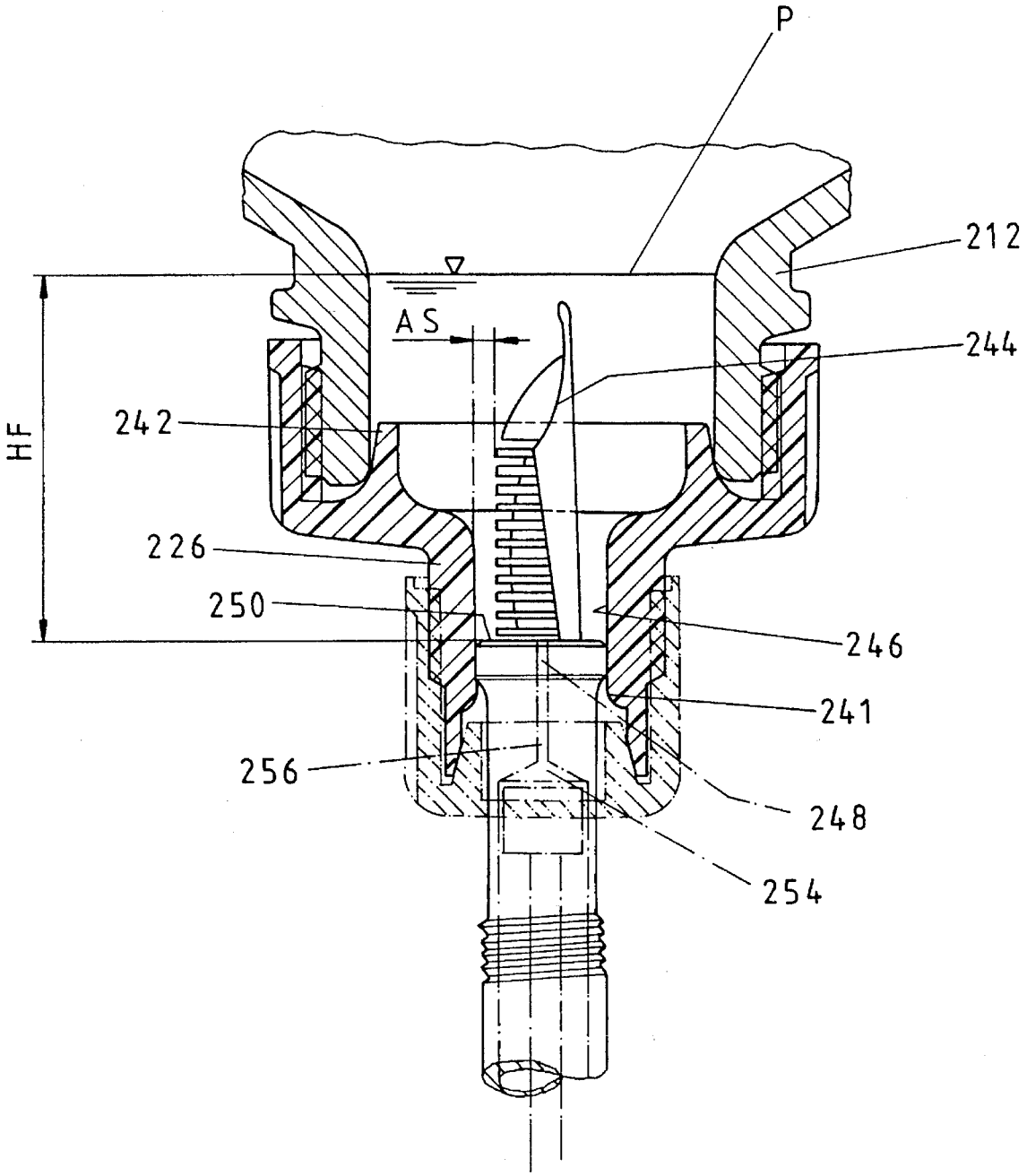
FIG. 12 shows, on a somewhat reduced scale, a vertical section of the upper spare bottle section with docked fountain pen, in which the spare bottle is in the upside-down position.

The screwed connection of the attachment 210 to the neck 212 of the spare bottle 300 is fluid-tight, in which case, in the embodiment example according to FIG. 10, for this purpose an annular sealing web 242 is formed in one piece onto the underside of the radial constriction 224 which, with the screwing on of the attachment, comes into increasing surface contact with the neck 212 of the spare bottle 300. Consequently, the inner chamber of the spare bottle 300, after the fountain pen or the refillable cartridge is docked, is closed so as to be both fluid-tight and gas-tight. In this state, the entirety constituted by the spare bottle 300 with attachment 210 and docked fountain pen, can be brought into the upside-down position (FIG. 12). However, a filling in the position shown in FIG. 9 is also possible.

The ink present in the spare bottle 300 or the residual ink still contained therein accordingly flows into the neck 212 of the spare bottle 300 and builds up there even if merely an insignificant residual ink volume has remained in the spare bottle to a level P, which is sufficiently high for flowing around the entire nib 244 and for the nib to be adequately submerged. Owing to the, in comparison with the neck 212, reduced internal diameter of the docking section 226 and due to the provision of the sealing web 242, the filling height HF is still maintained at a sufficiently high level even if merely the bottom of the spare bottle 300 were still to be wetted with ink (FIG. 12).

The by preference radially elastic construction of the docking section 226 provides for the inner wall 246 of the docking section nestling fluid-tight against the outer surface 248 of the marginal region of the fountain pen tip, in which case an axial positioning of the fountain pen relative to the docking section 226 can be effected by means of the sealing lips 241 in that the lip region snaps closed behind the pointed section, i.e. behind the outer surface 248. In the upside-down position of the ink bottle 214 according to FIG. 12, accordingly only the front face 250 facing the nib is wetted with ink.

Either already prior to the ink bottle with docked fountain pen being turned, or, in the position according to FIG. 12, by actuating the filling piston 252 indicated by a dash-dotted line in this figure, the same is moved into the frontmost position, whereby air is displaced in the outward direction from the ink reservoir 254 via a duct 256 and the nib 244, i.e. into the spare bottle 300. Since the docking section 226, in interaction with the outer surface 248 of the fountain pen, seals the inner chamber of the spare bottle 300 in a fluid-tight and, thereby, gas-tight manner, an internal pressure PI is built up inside the spare bottle 300, which is slightly greater than the ambient pressure. By turning the filling piston 252 back, due to the constant circumcirculation by the ink of the nib 244 and assisted by the slightly raised internal pressure PI, ink is drawn devoid of air or bubbles into the ink reservoir 254.

Following this, the entirety comprising the spare bottle 300 and the docked fountain pen, is turned around once more so that the fountain pen can be removed, released or disengaged from the docking section 226 (FIG. 9). Since, during the filling operation, merely the front surface 250 comes in contact with the ink, the fountain pen is very easily cleaned in that only the front face 250 is dabbed off or wiped with a dry rag. At any rate, it is impossible for remnants of ink to remain in the gripping zone of the fountain pen.

After the spare bottle 300 has been used, the same can be closed so as to be airtight by placing the screw cap 228 or **301*a* on the docking section 226 so that the ink in the spare bottle will not age when the bottle is not in use over a prolonged period (FIGS. 11 and 12**).

In FIG. 9, a further embodiment of the attachment for the spare bottle 300 is depicted. In this illustration, components which are comparable with those of the embodiment according to the FIGS. 10 and 12, have been provided with reference numbers that are preceded by a "4".

Figure 13:
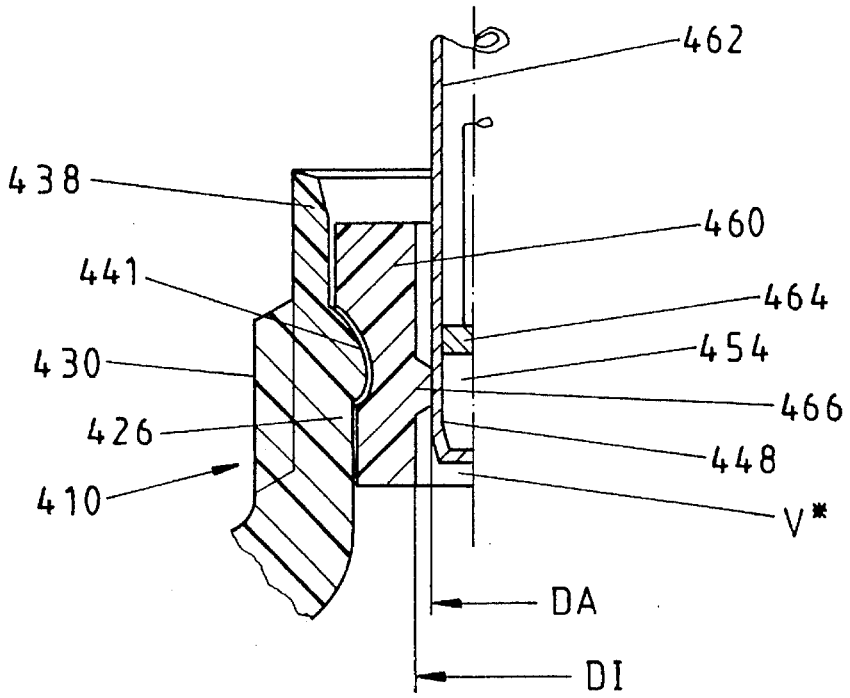
FIG. 13 shows a semisection of the upper region of an attachment according to a second embodiment with the screw cap removed.

The embodiment according to the FIG. 13 does not differ within the region of the docking section 426 or within the region of the upper collar 438 from the embodiment described in the foregoing. Also within the sealing lip region 440, an annular bead 441 is provided once again so as to form a sealingly locking or spring-loaded connection with a connecting piece to be docked on of a piston-type fountain pen. The peculiarity of the embodiment according to FIG. 13 consists in that the docking section 426 accommodates an inter-changeable adapter 460 which is positionwise and sealably positionable by means of the annular bead 441. Essentially the adapter 460 possesses the configuration of a hollow cylinder whose diameter DI is insignificantly larger than the external diameter DA of a refillable cartridge identified with 462, in which a filling piston 464 is likewise movably accommodated. The internal surface of the adapter 460 is provided with a sealing bead 466 which consists of elastic material and which, when the refillable cartridge 462 is introduced, bears accuractely and, thereby, fluid-tight against the outer wall of the cartridge 462. The adapter 460 can be adapted to different fountain pen diameters.

In a departure from the illustration according to FIG. 13, it is possible over and above that to construct the adapter 460 in such a way that, when the refillable cartridge 462 is inserted, an axial impact is applied to the cartridge so as to prevent the cartridge from being inserted into the adapter 460 either too little or too far. When the refillable ink cartridge is applied or docked—as already described in the foregoing—the entirety comprised of the spare bottle 300 and the cartridge 462 is brought into an upside-down position.

It becomes apparent from the illustration according to the FIG. 13 that the design of the attachment makes it possible to empty the spare bottle 300 down to a residual volume V* which surrounds the tip of the refillable ink cartridge in the region of the adapter 460.

The adapter is by preference designed in such a way that it may remain in the docking section for the closing of the spare bottle or the attachment with the screw cap. According to a further advantageous embodiment it may be provided for the adapter 460 to be fitted with gripping means so as to facilitate the replacement of the adapter 460.

Figure 14:
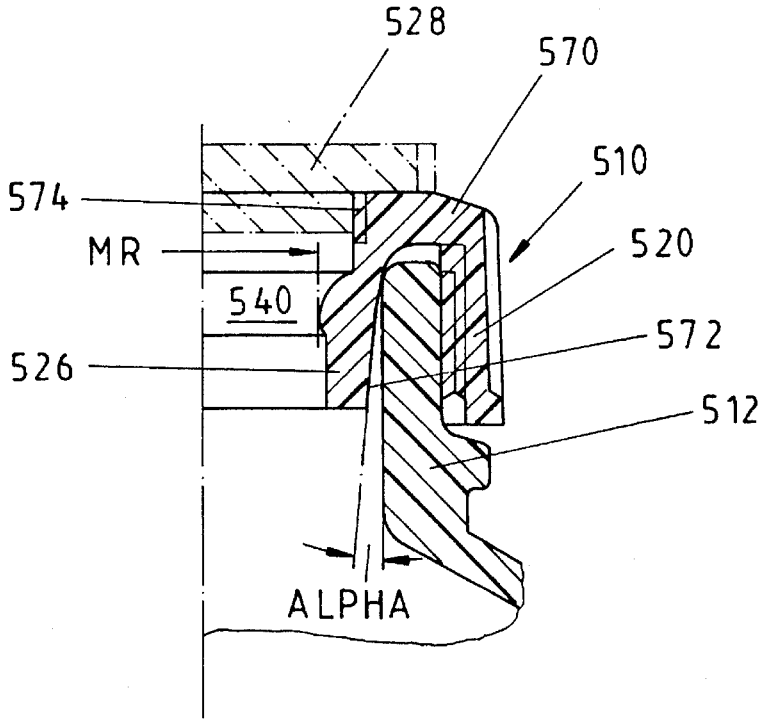
FIG. 14 shows a semisection of the upper region of a spare bottle with screwed-on attachment according to a third embodiment.

Finally, with the aid of FIG. 14, a still further embodiment of the attachment for spare bottles is to be described which differs from the embodiments previously described in that the axial structural height is reduced. In this embodiment, those components which are comparable with the elements of the embodiment according to FIGS. 10 and 12, are once again provided with the same reference numbers which, however, are preceded by a "5".

The collar section 520 of the attachment 510 is screwed onto the neck 512 of the spare bottle. In a departure from the previously described embodiment examples, the docking section 526 is disposed radially within the collar section 520 and, with the aid of a radial web 570, is connected to the latter so as to form one piece. An outer circumferential surface 572 of the docking section 526 is tapered conically at an angle ALPHA toward the inside so that, when the collar section 520 is screwed on, a constantly more intimate sealing contact between the docking section 526 and the spare bottle neck 512 is produced. That is why the docking section 526 acts in the embodiment according to FIG. 14 at the same time as a sealing collar. An annular bead 540 located on the inside and formed onto the docking section 526 renders the docking section adaptable to different fountain pen diameters.

Over and above that it is possible to effect an influencing of the radial dimensions MR by means of a more or less firm screwing-on of the attachment 510, whereby an universal applicability of the attachment 510 for the most widely varied constructions of connecting pieces of eithher the fountain pens or of refillable cartridges results. An internal thread 574 is provided within the upper region of the docking section 526, into which a sealing cap 528 can be screwed for the airtight closure of the spare bottle with attachment 510.

Departures from the previously described embodiment examples are of course possible without leaving the basic concept of the invention. It is thus possible, by way of example, to finely adjust the radial internal width of the docking section with the aid of a clamping ring in order to, in this manner, effect an adaptation to different external fountain pen diameters. It is also possible to operate with highly elastic docking sections which, when fountain pen terminal sections possessing various thicknesses are inserted, are then more or less strongly radially widened. The attachment is preferably fabricated from a plastic material, a transparent construction of the plastic possesses the advantage that the ink level in the upside-down position of the spare bottle relative to the position of the nib can be monitored.

In the embodiment shown in FIG. 11, the docking section 226 can at the same time be an integral part of the spare bottle 300. The docking section 226 is provided with an external thread 226*c*, onto which the cap portion 301*b* can be screwed. This screw cap 301*b*, within its terminal region 301*b*', passes into a nozzle-like shape which is centrally provided with a perforation 301*b*". The cap portion 301*b* is provided with an external thread 302, onto which the cap portion 301*a* can be screwed, which is provided with an internal thread engaging into the external thread 302. According to this the cap portion 301*b* is constructed at its point in the form of an open pipette tip. With this pipette point or tip the possibility exists of refilling ink from a larger ink bottle by a simple compression of the spare bottle 300 and by discontinuing the application of pressure on this spare bottle. The cap portion 301*b* is for this reason fabricated from springably elastic plastic. However, the possibility also exists of screwing the docking section 226 onto the spare bottle 300 when the same is provided with an external thread (FIG. 10). In this embodiment, the top opening of the docking section 226 can be closed with the aid of the cap portion 301*a*. The cap portion 301*b* constructed so as to comprise a pipette point or tip can be stored and carried separately when a simple refilling of the spare bottle 300 from an ink supply bottle becomes necessary.

The attachment 210, 410 or 510 can be closed by means of a one-piece cap portion 301 or with the aid of a two-piece cap portion 301*a*, 301*b*, in which case the internal cap portion 301*b* is retained on the outer wall surface of the attachment 210, 410 or 510 with the aid of a screwing, plugging or clipping means and, at its free end 301*b*', constructed in the form of an open 301*b*" pipette point. The internal cap portion 301*b* can be covered with the aid of an attachable second cap portion 301*a*, the cap portion 301 a being detachably retained on the outer wall surface of the internal cap portion 301*b* by means of a screwed, plugged or clipped connection.

What is claimed is:

1. A spare bottle for ink refilling of piston-type fountain pens having an ink reservoir, a terminal section, and an ink conducting system communicating the terminal section with the ink reservoir, said spare bottle comprising:

a refilling container formed of low-density polyethylene and having a neck;

an attachment having a docking section for receiving the terminal section of a fountain pen and a collar section for sealingly engaging said neck, at least one of said collar section and said neck having a bead for providing a seal therebetween; and cap means for closing said spare bottle and including a cap portion sealingly enclosing said attachment and means for securing said cap portion on said attachment;

wherein said securing means comprises a center pin sealingly engaging an inner surface of said attachment in a closed position of said sealing bottle, and wherein said cap portion has, within a region of said center pin, an absorbent wick projecting out of said cap portion.

2. A spare bottle according to claim 1, wherein said cap means comprises a sealing cap detachably securable on said cap portion and shielding said wick.

3. A spare bottle according to claim 2, wherein said cap portion has an outer thread and said sealing cap has an inner thread for detachably securing said sealing cap on said cap portion.

4. A spare bottle according to claim 2, wherein said sealing cap has a through hole in a bottom thereof.

5. A spare bottle for ink refilling of piston-type fountain pens having an ink reservoir, a terminal section, and an ink conducting system communicating the terminal section with the ink reservoir, said spare bottle comprising:

a refilling container formed of low-density polyethylene and having a neck;

an attachment having a docking section for receiving the terminal section of a fountain pen and a collar section for sealingly engaging said neck, at least one of said collar section and said neck having a lead for providing a seal therebetween;

cap means for closing said spare bottle and including a cap portion sealingly enclosing said attachment and means for securing said cap portion on said attachment; and at least one interchangeable adapter receivable in said docking section of said attachment for accommodating a different geometry of one of the terminal portion of an fountain pen and refilling cartridge of the fountain pen, said at least one interchangeable adapter having a sealing lip for sealingly engaging the one of the terminal portion of the fountain pen and a refilling cartridge of the fountain pen.

6. A spare bottle according to claim 5, wherein at least one of said docking section and said adapter is formed, at least partially, of elastic material.

7. A spare bottle according to claim 6, wherein said elastic material is a plastic material having required properties.

8. A spare bottle for ink refilling of piston-type fountain pens having an ink reservoir, a terminal section, and an ink conducting system communicating the terminal section with the ink reservoir, said spare bottle comprising:

a refilling container formed of low-density polyethylene and having a neck;

an attachment having a docking section for receiving the terminal section of a fountain pen and a collar section for sealingly engaging said neck, at least one of said collar section and said neck having a bead for providing a seal therebetween; and cap means for closing said spare bottle and including a cap portion sealingly enclosing said attachment and means for securing said cap portion on said attachment;

wherein said securing means comprises a center pin sealingly engaging an inner surface of said attachment in a closed position of said sealing bottle; and wherein said docking section comprises a cylindrical portion having a conical inner surface, said center pin defining, together with a wall of said cap portion a recess, said cylindrical portion of said docking section extending into said recess, with outer and inner surfaces of said cylindrical section sealingly engaging respective surfaces of said center pin and said wall of said cap portion.

9. A spare bottle for ink refilling of piston-type fountain pens having an ink reservoir, a terminal section, and an ink conducting system communicating the terminal section with the ink reservoir, said spare bottle comprising:

a refilling container formed a of low-density polyethylene and having a neck;

an attachment having a docking section for receiving the terminal section of a fountain pen and a collar section for sealingly engaging said neck, at least one of said collar section and said neck having a lead for providing a seal therebetween; and cap means for closing said spare bottle and including a cap portion sealingly enclosing said attachment and means for securing said cap portion on said attachment;

wherein said cap portion is formed of internal and external cap parts, with the internal cap part having a portion remote from said docking section and having a pipette tip shape;

wherein said internal cap part has a lower portion lockingly engaging a wall of said docking section; and wherein said lower portion has snap means for snappingly engaging said docking section.

10. A spare bottle for ink refilling of piston-type fountain pens having an ink reservoir, a terminal section, and an ink conducting system communicating the terminal section with the ink reservoir, said spare bottle comprising:

a refilling container formed a low-density polyethylene and having a neck;

an attachment having a docking section for receiving the terminal section of a fountain pen and collar section for sealingly engaging said neck, at least one of said collar section and said neck having a bead for providing a seal therebetween; and cap means for closing said spare bottle and including a cap portion sealingly enclosing said attachment and means for securing said cap portion on said attachment;

wherein said securing means comprises a center pin sealingly engaging an inner surface of said attachment in a closed position of said sealing bottle, and wherein said collar section of said attachment has a radial collar located inside said neck and having a central opening, and said center pin has a bottom lying on said collar for closing said central opening.

* * * * *